US006470726B1

(12) United States Patent
Murata et al.

(10) Patent No.: US 6,470,726 B1
(45) Date of Patent: Oct. 29, 2002

(54) METHOD FOR MANUFACTURING AN EXTRUDED ARTICLE CHANGING IN CROSS-SECTION AND AN APPARATUS FOR EXTRUDING SAID EXTRUDED ARTICLE

(75) Inventors: Makoto Murata, Yokohama; Koji Hasegawa, Tokyo; Masatoshi Enomoto, Tochigi, all of (JP)

(73) Assignee: Showa Denko, K.K., Tokyo (JP)

( * ) Notice: Subject to any disclaimer, the term of this patent is extended or adjusted under 35 U.S.C. 154(b) by 0 days.

(21) Appl. No.: 09/723,175

(22) Filed: Nov. 27, 2000

(30) Foreign Application Priority Data

Dec. 28, 1999 (JP) ..... 11-374436

(51) Int. Cl.[7] ..... B21C 25/08

(52) U.S. Cl. ..... 72/260; 72/264; 72/265; 264/167; 264/209.2; 425/465; 425/466

(58) Field of Search ..... 72/260, 264, 265, 72/268, 269; 264/167, 177.16, 209.2; 425/381, 465, 466, 467

(56) References Cited

U.S. PATENT DOCUMENTS

| | | | | |
|---|---|---|---|---|
| 2,819,794 A | | 1/1958 | Krause | |
| 2,903,130 A | | 9/1959 | Reichl | |
| 3,422,648 A | | 1/1969 | Lemelson | |
| 4,546,634 A | * | 10/1985 | Fuchs, Jr. | 72/265 |
| 5,438,858 A | * | 8/1995 | Friedrichs | 72/260 |
| 5,775,155 A | * | 7/1998 | Kato et al. | 72/260 |
| 5,989,466 A | * | 11/1999 | Kato et al. | 72/265 |

FOREIGN PATENT DOCUMENTS

| | | | | |
|---|---|---|---|---|
| DE | 53 479 | | 1/1890 | |
| EP | 0129010 | | 12/1984 | |
| GB | 1075894 | | 7/1967 | |
| JP | 62-282722 | * | 12/1987 | 72/260 |
| JP | 6-198328 | * | 7/1994 | 72/260 |
| JP | 6-297032 | * | 10/1994 | 72/260 |

* cited by examiner

*Primary Examiner*—Ed Tolan

(57) ABSTRACT

An extruded article which has at least one hollow portion and changes in cross-section along a direction of an extrusion axis is manufactured by the method. The method includes the step of advancing a punch to extrude a billet while controlling a movement of a mandrel for defining an inner periphery of the hollow portion relative to a die for defining an outer periphery of the extruded article.

19 Claims, 9 Drawing Sheets

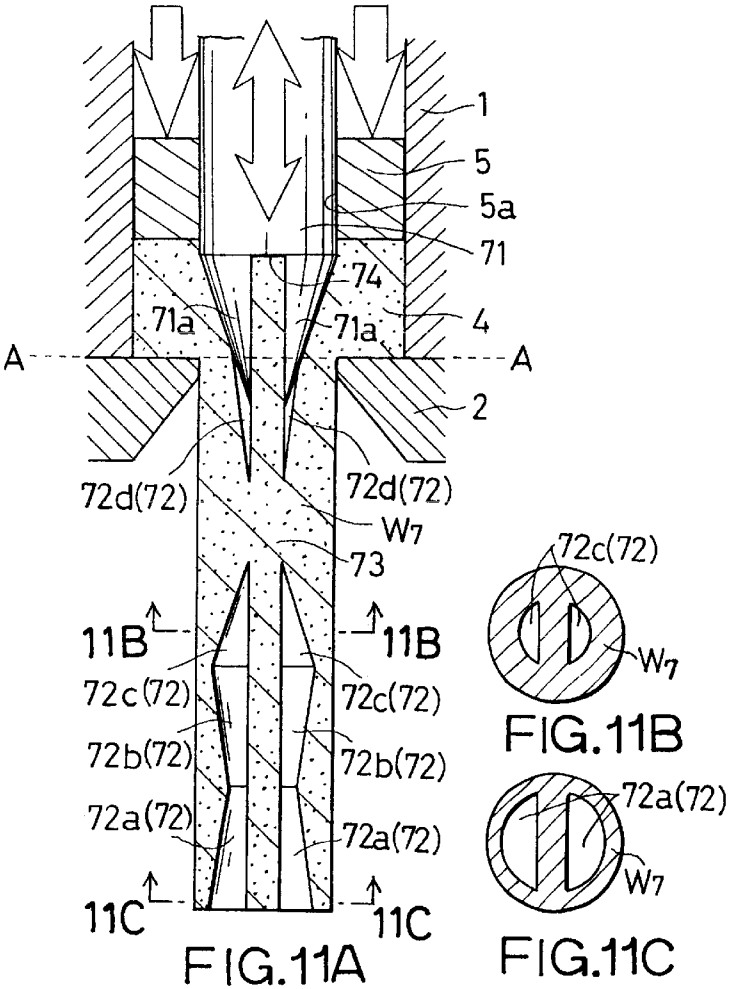
FIG.11A
FIG.11B
FIG.11C
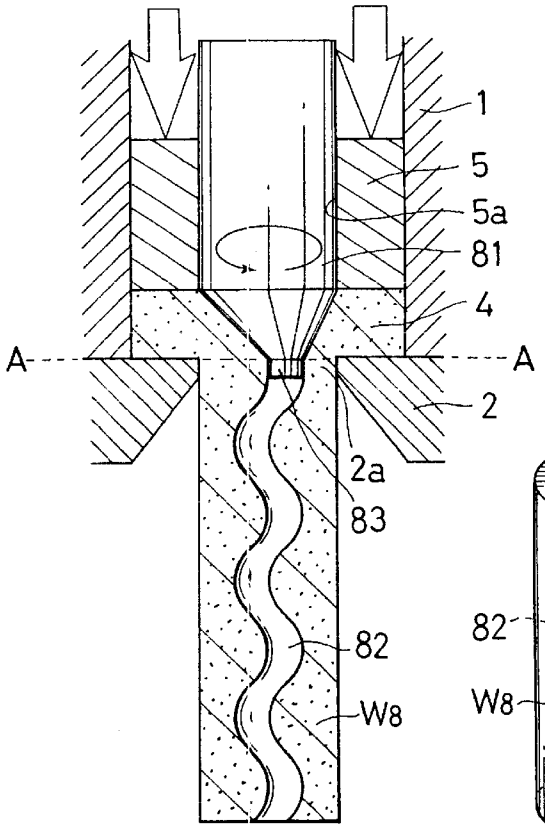
FIG.12A
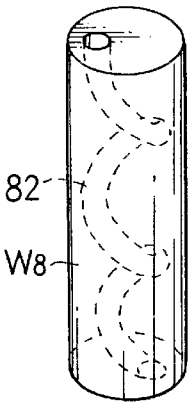
FIG.12B

METHOD FOR MANUFACTURING AN EXTRUDED ARTICLE CHANGING IN CROSS-SECTION AND AN APPARATUS FOR EXTRUDING SAID EXTRUDED ARTICLE

BACKGROUND OF THE INVENTION

1. Field of the Invention

The present invention relates to a method for manufacturing an extruded article made of metal or polymer such as plastic and changing in cross-section along a direction of an extrusion axis. The present invention also relates to an apparatus for extruding such an extruded article.

2. Description of Related Art

A pipe member and a shaped member made of metal or plastic have been widely used for various industrial fields for the purpose of lightening the member and/or the whole product since such a member is high in flexural stiffness and torsional stiffness for its weight. In many cases, such a member is manufactured by an extrusion method which is excellent in manufacture efficiency.

However, an extruded article has the same cross-section along the entire length thereof since the extruded article is formed by extruding a billet through a bearing hole of a die having a fixed cross-section. Therefore, in the event that an extruded article is required to have different strength at longitudinally different portions so as to withstand different external force such as bending moment at different portions, the extruded article is designed to have the same cross-section along the entire length thereof so as to withstand the maximum external force.

Consequently, the extruded article includes a portion unnecessarily high in strength such as an unnecessary thick portion, which raises the material cost of the whole extruded article and the weight thereof.

Furthermore, in the event that an extruded article is used as a part of a product and that the end portion of the extruded article is to be joined to another member by welding or the like, the cross-sectional area of the end portion of the extruded article may sometimes be required to have a cross-sectional area larger than that of the remaining portion thereof so as to enhance the joint strength. However, it was impossible for a conventional manufacturing method to cope with the aforementioned requirements.

SUMMARY OF THE INVENTION

An object of the present invention is to provide a method for manufacturing an extruded article changing in cross-section along a direction of an extrusion axis.

Another object of the present invention is to provide an apparatus for manufacturing such an extruded article.

In order to attain the aforementioned object, according to a first aspect of the present invention, a method for manufacturing an extruded article which has at least one hollow portion and changes in cross-section along a direction of an extrusion axis, includes the step of advancing a punch to extrude a billet while controlling a movement of a mandrel for defining an inner periphery of the hollow portion relative to a die for defining an outer periphery of the extruded article.

It is preferable that the mandrel is controlled so as to advance or retreat in the direction of the extrusion axis while the punch is advancing.

The mandrel may be controlled so as to retreat until a tip end of the mandrel is located behind a bearing hole of the die while the punch is advancing.

The mandrel may have a tip end portion asymmetrical to a rotary axis of the mandrel, and the mandrel may be controlled so as to rotate about the extrusion axis or an axis parallel to the extrusion axis while the punch is advancing.

A moving speed of the mandrel may be controlled independently of a moving speed of the punch.

The mandrel may be controlled so as to move continuously or intermittently.

The aforementioned method for manufacturing an extruded article may further include the steps of applying a pressure to the billet in a state in which a bearing hole of the die is closed to fill the bearing hole with the billet and releasing a closing of the bearing hole prior to the step of extruding the billet by the mandrel and the punch.

According to a second aspect of the present invention, an apparatus for manufacturing an extruded article which has at least one hollow portion and changes in cross-section along a direction of an extrusion axis, includes a container in which a billet is loaded, a punch for applying a forward pressure to the billet, a mandrel for defining an inner periphery of the hollow portion and a die for defining an outer periphery of the extruded article. The mandrel is capable of moving relative to the die, whereby the extruded article is formed by advancing the punch to extrude the billet while controlling a movement of the mandrel relative to the die.

The mandrel may be capable of advancing and/or retreating relative to the die.

Furthermore, the mandrel may have a tip end portion asymmetrical to a rotary axis of the mandrel, and the mandrel may be capable of rotating about the extrusion axis while the punch is advancing.

BRIEF DESCRIPTION OF THE DRAWINGS

The present invention will be more fully described and better understood from the following description, taken with the appended drawings, in which:

FIG. 11A is a schematic cross-sectional view showing an extrusion process of a manufacturing method using a mandrel with spread tip ends according to a seventh embodiment of the present invention;

FIG. 11B is a cross-sectional view taken along the line 11B—11B in FIG. 11A;

FIG. 11C is cross-sectional view taken along the line 11C—11C in FIG. 11A;

FIG. 12A is a schematic cross-sectional view showing an extrusion process of a manufacturing method according to an eighth embodiment of the present invention;

FIG. 12B is a perspective view of the manufactured extruded article;

FIG. 14 is schematic cross-sectional view showing an extrusion process of a manufacturing method by which an extruded article having a closed end is formed according to a tenth embodiment of the present invention, wherein FIG. 14A shows the process of forming the closed end, and wherein

DETAILED DESCRIPTION OF THE PREFERRED EMBODIMENTS

Figure 1:
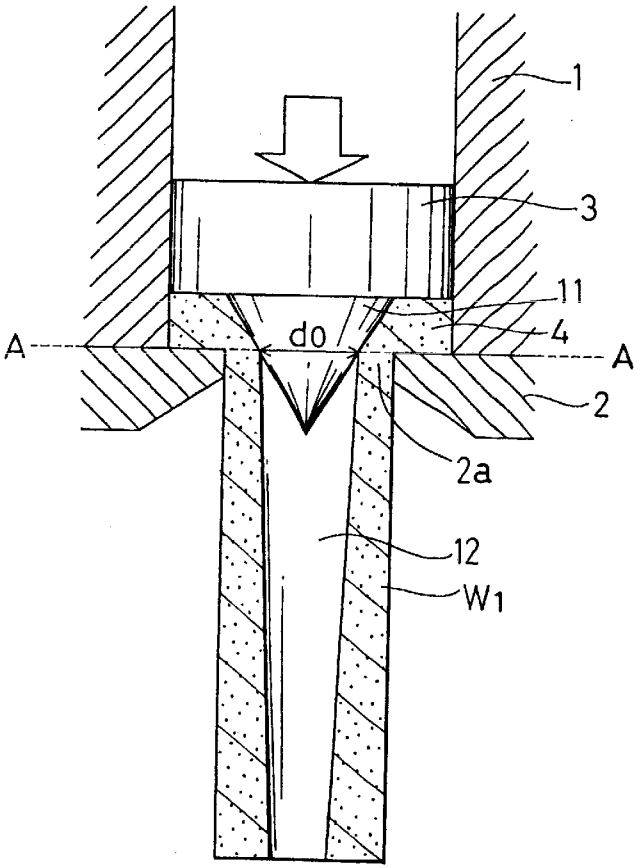
FIG. 1 is a schematic cross-sectional view showing an extrusion process of a manufacturing method according to a first embodiment of the present invention.

The extrusion apparatus according to the following first to eleventh embodiments shown in FIGS. 1 to 15A includes a die 2 fixedly disposed at the front end of a container 1 to define an outer periphery of an extruded article W1, W2, W3, W4, W5, W6, W7, W8, W9, W10 or W11 and a mandrel 11, 21, 51, 61, 71, 81, 91 or 101 which defines an inner peripheral surface of a hollow portion 12, 22, 32, 42, 52, 62, 72, 82, 92 or 102.

In the aforementioned extruding apparatus, the billet 4 loaded in the container 1 is extruded by advancing the punch 3 or 5 while moving the mandrel 11, 21, 51, 61, 71, 81, 91 or 101 relative to the die 2.

At this time, the extruded article W1, W2, W3, W4, W5, W6, W7, W8, W9, W10 or W11 changing in cross-section along the direction of the extrusion axis can be manufactured by advancing the punch 3 while changing the position of the mandrel 11, 21, 51, 61, 71, 81, 91 or 101 relative to the fixed die 2, or changing the moving direction and moving speed of the mandrel 11, 21, 51, 61, 71, 81, 91 or 101.

The mandrel 11, 21, 51, 61, 71, 81, 91 or 101 is required not to have an enlarged diameter portion at the tip end thereof, taking into account of the feature of an extrusion.

However, in the present invention, a mandrel is not limited to the mandrel shown in each embodiment so long as it can form a hollow portion through an extrusion process.

Moreover, the composition of the billet is not particularly limited so long as it is metal or polymer such as plastic to which a mobility can be given such that an extrusion can be performed.

The explanation concerning the same reference numeral allotted in the following embodiments and drawings will not be repeated as the same reference numeral achieves the same function.

First Embodiment

As shown in FIG. 1, the mandrel 11 is formed to have a cone-shape with a diameter decreasing toward the tip end, and is arranged so that the axis thereof coincides with the extrusion axis. The basal end of the mandrel 11 is integrally secured to the punch 3, and the mandrel 11 advances together with the punch 3, i.e., advances at the same speed as that of the punch 3.

In this extruding apparatus equipped with the aforementioned mandrel 11, a hollow billet 4 having a central hole corresponding to the mandrel shape is loaded in the container 1, and then extruded in accordance with the advance movement of the punch 3. This causes an advance movement of the mandrel 11, increasing an insertion amount of the mandrel 11 into the bearing hole 2*a*.

The advance movement of the mandrel 11 causes a gradual increase of the outer diameter d0 of the mandrel 11 corresponding to the inner peripheral edge of the bearing hole 2*a*, i.e., corresponding to the line A—A in FIG. 1, which in turn causes a gradual decrease of the gap between the die 2 and the mandrel 11 to form the hollow portion 12 of the extruded article W1 having a gradually increased inner diameter.

As mentioned above, by advancing the mandrel 11 continuously changing in outer diameter, the gap between the die 2 and the mandrel 11 continuously decreases to form a tapered hollow portion 12.

Although the cone-shaped mandrel 11 is illustrated in this embodiment, a pyramid-shaped mandrel can also form a tapered hollow portion of a polygonal cross-sectional shape by the same process as in the aforementioned embodiment. In addition to the aforementioned mandrels, various mandrels can be used. For example, a truncated cone-shaped mandrel, a truncated pyramid-shaped mandrel, a mandrel having a cylindrical main body and a cone-shaped tip end, a mandrel which is round in cross-section, a mandrel which is ellipse in cross-section and a mandrel which is polygonal in cross-section can also be used.

Furthermore, although the aforementioned mandrel 11 is integrally secured to the punch 3 to form a tapered hollow portion, in cases where an operation of a mandrel is controlled independently of an operation of a punch, the same tapered hollow portion as shown in FIG. 1 can also be formed by advancing both the mandrel and the punch at the same velocity.

Second Embodiment

Figure 2:
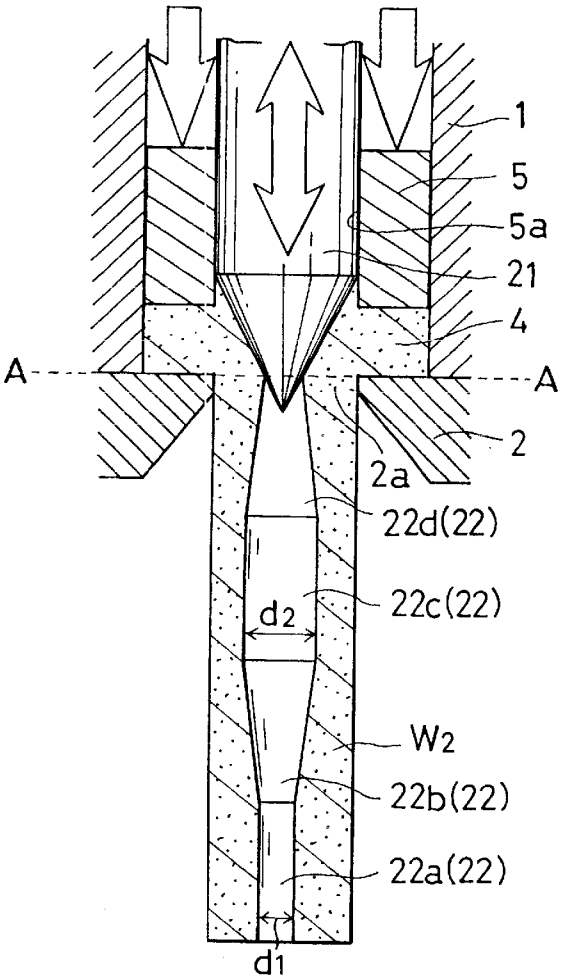
FIG. 2 is a schematic cross-sectional view showing an extrusion process of a manufacturing method according to a second embodiment of the present invention.

As shown in FIG. 2, the mandrel 21 is inserted in the penetrated hole 5*a* formed in the punch 5 such that the mandrel 21 can advance and retreat in the penetrated hole 5*a*. The moving direction of the mandrel 21 and the moving speed thereof are controlled independently of the advancing movement of the punch 5.

The tip end portion of the mandrel 21 is formed to have a cone-shape with the diameter decreasing toward the tip end.

In this extruding apparatus, in the same way as in the first embodiment, the inner diameter of the hollow portion 22 of the extruded article W2 is defined by the gap between the die 2 and the mandrel 21, i.e., the inserted amount of the mandrel 21 into the bearing hole 2*a* of the die 2.

Therefore, when the punch 5 is advanced in a state in which the mandrel 21 is stopped, the hollow portion 22 is formed to have a constant cross-section corresponding to the inserted amount of the mandrel 21 into the bearing hole 2*a* (i.e., corresponding to the outer diameter of the mandrel at the bearing inner peripheral edge).

When the billet 4 is extruded while advancing the mandrel 21, the hollow portion 22 gradually becomes larger in diameter. On the other hand, when the billet 4 is extruded while retreating the mandrel 21, the hollow portion 22 gradually becomes smaller in diameter.

In the extruded article W2 shown in FIG. 2, the hollow portion 22 includes a first hollow portion 22*a* having a constant diameter d1, a second hollow portion 22*b* having a gradually increasing diameter from d1 to d2, a third hollow portion 22*c* having a constant diameter d2 and a fourth hollow portion 22*d* gradually decreasing diameter from d2.

The extrusion process of the aforementioned extruded article W2 will be explained, with referring to FIGS. 3–6.

(Step 1)

Figure 3:
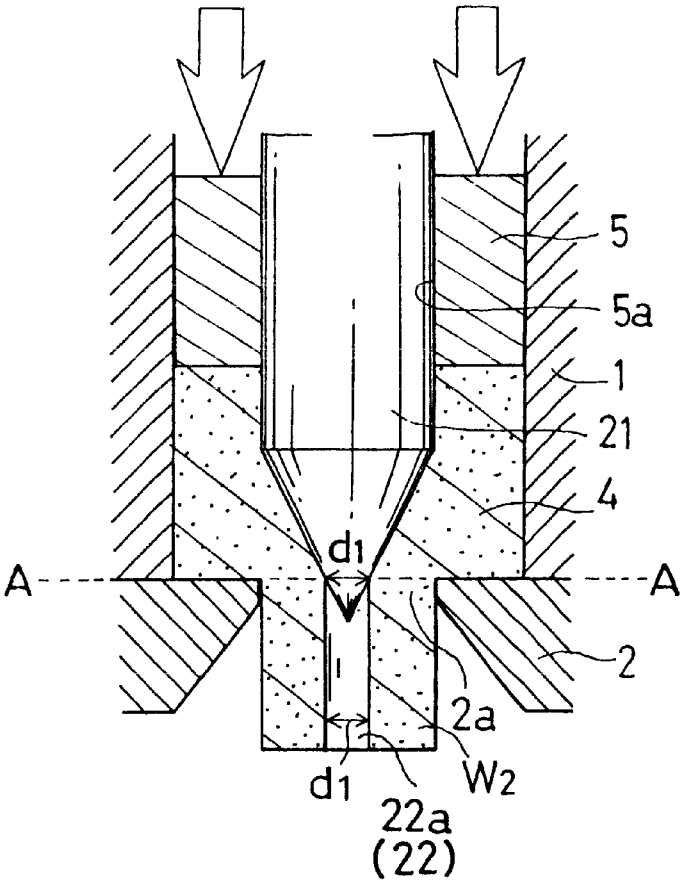
FIG. 3 is a schematic cross-sectional view showing the extrusion process for forming a constant diameter hollow potion shown in FIG. 2.

As shown in FIG. 3, the mandrel 21 is fixed at the position where the diameter of the mandrel 21 corresponding to the inner peripheral edge of the bearing hole 2*a* of the die 2, i.e., corresponding to the line A—A in FIG. 3, is d1. In this state in which the mandrel 21 is fixed, the punch 5 is advanced. This operation forms the first hollow portion 22*a* having a constant diameter d1.

(Step 2)

Figure 4:
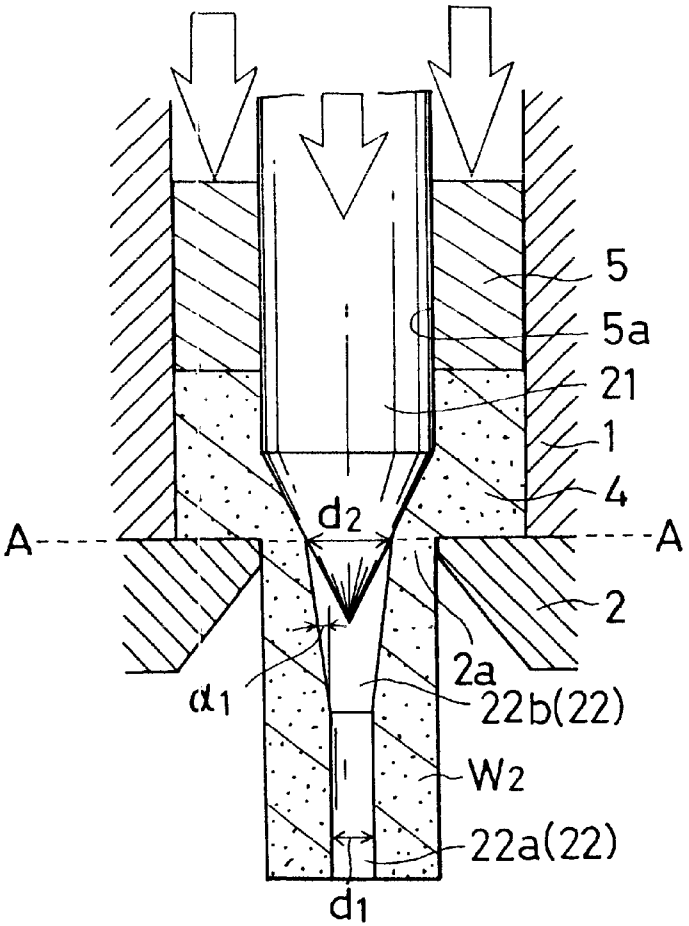
FIG. 4 is a schematic cross-sectional view showing the extrusion process for forming an increasing diameter hollow portion shown in FIG. 2.

As shown in FIG. 4, the mandrel 21 is advanced until the outer diameter thereof corresponding to the aforementioned line A—A becomes d2 while advancing the punch 5. This operation forms the second hollow portion 22*b* in which the diameter of the hollow portion 22*b* increases from d1 to d2. At this time, the taper angle $\alpha$1 of the hollow portion 22*b* can be adjusted by controlling the relative relation between the extruding speed of the billet 4 and the advancing speed of the mandrel 21. For example, the faster the extruding speed relative to the advancing speed of the mandrel 21 becomes, the smaller the taper angle $\alpha$1 becomes.

(Step 3)

Figure 5:
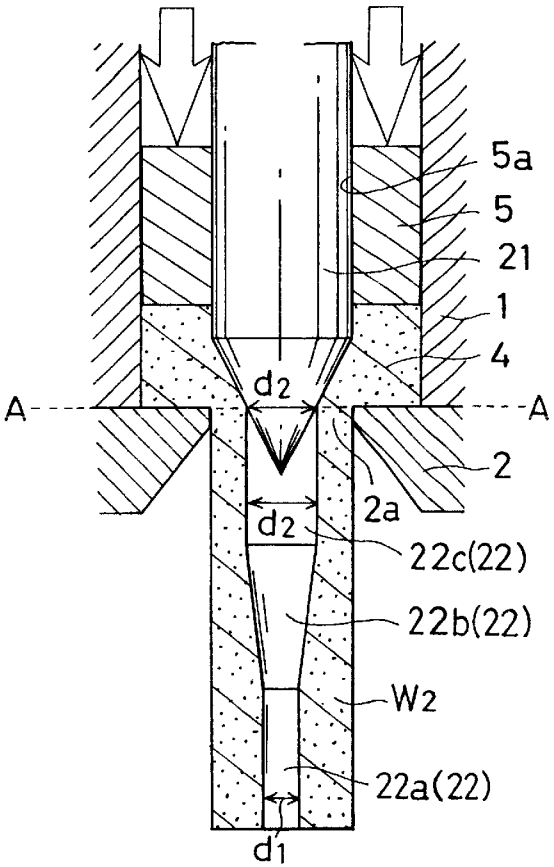
FIG. 5 is a schematic cross-sectional view showing the extrusion process for forming a constant diameter hollow portion shown in FIG. 2.

As shown in FIG. 5, when the outer diameter of the mandrel 21 corresponding to the line A—A became d2 in step 2, the advance movement of the mandrel 21 is stopped. Subsequently, the punch 5 is advanced in the state in which the mandrel 21 is stopped. This operation forms the third hollow portion 22*c* having a constant diameter d2.

(Step 4)

Figure 6:
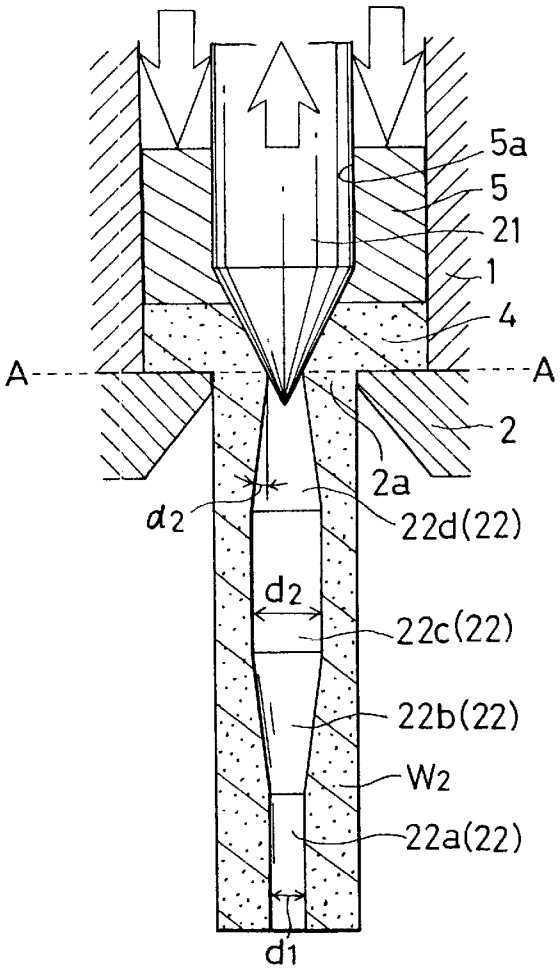
FIG. 6 is a schematic cross-sectional view showing the extrusion process for forming a decreasing diameter hollow portion shown in FIG. 2.

As shown in FIG. 6, the punch 5 is advanced while retreating the mandrel 21. By this operation, the outer diameter of the mandrel 21 corresponding to the line A—A gradually becomes smaller, which gradually reduces the diameter of the hollow portion 22*d*. At this time, the taper angle $\alpha$2 of the hollow portion 22*d* can be adjusted by controlling the relative relation between the extruding speed of the billet 4 and the advancing speed of the mandrel 21. For example, the faster the extruding speed relative to the advancing speed of the mandrel 21 becomes, the smaller the taper angle $\alpha$2 becomes.

In this embodiment, the extrusion is performed so as to linearly change the diameter of the hollow portion 22 at the taper angle $\alpha$1 and $\alpha$2 at the second and fourth hollow portions 22*b* and 22*d*, respectively, by keeping the relative relation between the extruding speed of the billet 4 and the moving speed of the mandrel 21 constant.

However, it is possible to arbitrarily set the relative relation between the extruding speed and the moving speed of the mandrel 21 by independently driving the mandrel 21 and the punch 5, which enables a change of the taper angle $\alpha$1, $\alpha$2 of the hollow portion 22.

Third Embodiment

By changing the operation of the mandrel 21 in the second embodiment, it is possible to manufacture an extruded article W3 different from the extruded article obtained in the second embodiment in cross-section.

Figure 7:
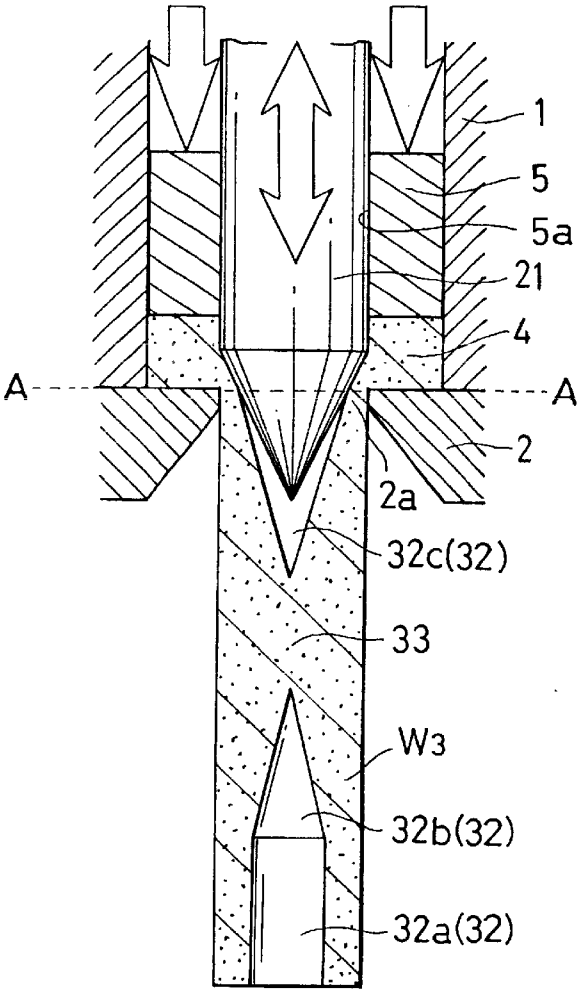
FIG. 7 is a schematic cross-sectional view showing an extrusion process of a manufacturing method according to a third embodiment of the present invention.

The extruded article W3 shown in FIG. 7 includes a hollow portion 32*a*, 32*b* and 32*c* and a non-hollow portion 33 along the direction of the extrusion axis.

The non-hollow portion 33 can be formed by advancing the punch 5 in the state in which the mandrel 21 is retreated behind the inner peripheral edge of the bearing hole 2*a* of the die 2, i.e., behind the line A—A. The operation of the mandrel 21 and the punch 5 in this embodiment shown in FIG. 7 will be explained as follows.

(Step 1)

The punch 5 is advanced in the state in which the mandrel 21 is stopped with the mandrel 21 inserted in the bearing hole 2*a*. This forms a constant diameter portion 32*a*.

(Step 2)

The punch 5 is advanced while retreating the mandrel 21. This forms a reducing diameter hollow portion 32*b*.

(Step 3)

The retreating movement of the mandrel 21 is stopped at the position behind the line A—A. Then, only the punch 5 is advanced. This forms a non-hollow portion 33.

(Step 4)

The punch 5 is advanced while advancing the mandrel 21. This forms an increasing diameter hollow portion 32*c*. FIG. 7 shows this step 4.

Fourth Embodiment

By changing the operation of the mandrel 21 in the second embodiment, it is possible to manufacture an extruded article W4 different from the extruded article obtained in the second embodiment in cross-section.

Figure 8:
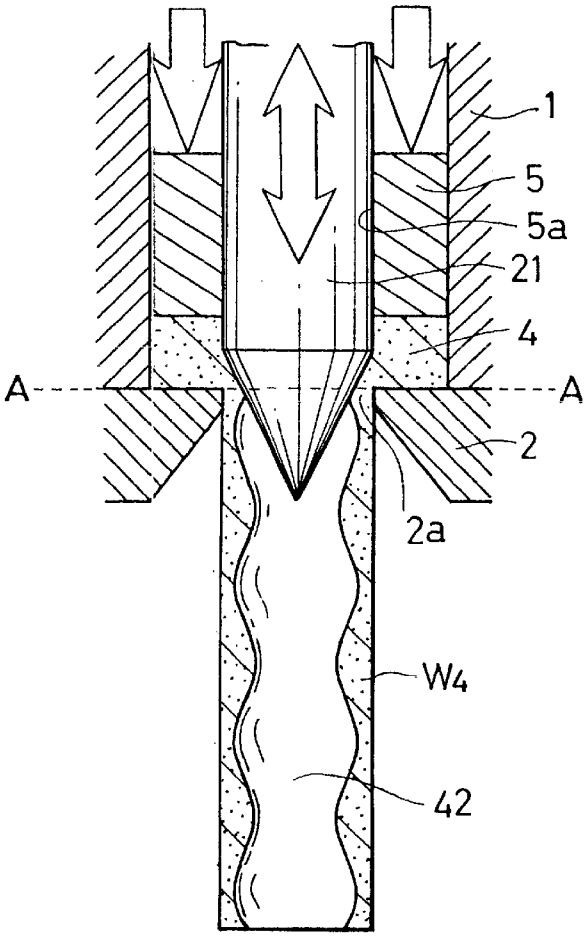
FIG. 8 is a schematic cross-sectional view showing an extrusion process of a manufacturing method by which an extruded article is formed while changing a speed of the mandrel according to a fourth embodiment of the present invention.

The extruded article W4 shown in FIG. 8 includes a curved hollow portion 42 in which the diameter changes repeatedly along the longitudinal direction thereof.

The hollow portion 42 is formed by advancing the punch 5 while repeatedly advancing and retreating the mandrel 21 and also changing the moving speed in the state in which the mandrel 21 is inserted into the bearing hole 2*a*. That is, the hollow portion 42 with the curved longitudinal inner surface is formed by combining the repeated advancing and retreating movements of the mandrel 21 and the repeated speed changes of the relative relation between the extruding speed of the billet 4 and the moving speed of the mandrel 21.

In the hollow portion 42, the diameter increasing portion corresponds to the advancing movement of the mandrel 21, and the diameter decreasing portion corresponds to the retreating movement of the mandrel 21.

Irrespective of the moving direction of the mandrel, the relative extruding speed of the billet 4 becomes slower at the portion in which the size change is rapid.

Fifth Embodiment

Figure 9:
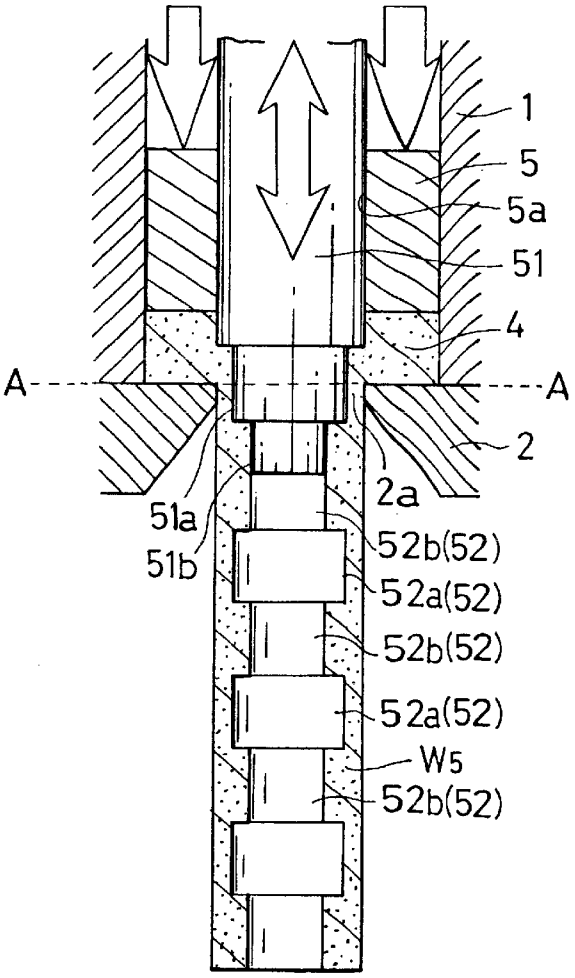
FIG. 9 is a schematic cross-sectional view showing an extrusion process of a manufacturing method using a stepped mandrel according to a fifth embodiment of the present invention.

In place of the cone-shaped tip end portion of the mandrel shown in the first to fourth embodiments in which the diameter changes continuously, a step-shaped tip end portion may be employed as shown in FIG. 9 in which the diameter changes stepwise. The mandrel having the step-shaped tip end can also manufacture an extruded article changing in cross-section along the direction of the extrusion axis by combining the advancing movement of the mandrel and the retreating movement thereof.

The mandrel 51 shown in FIG. 9 includes a basal portion and a two-stepped portion formed on the tip of the basal portion. The two-stepped portion is comprised of two columnar portions 51*a* and 51*b* different in diameter. The hollow portion 52 formed by the mandrel 51 has two different constant diameter portions corresponding to each outer diameter of the columnar portions 51*a* and 51*b*. Therefore, by combining the advancing movement of the mandrel 51 and the retreating movement thereof, the extruded article W5 which has a stepped hollow portion 52 including a larger diameter hollow portion 52*a* and a smaller diameter hollow portion 52*b* arranged by turns, can be formed.

The extruded article W5 is manufactured by extruding the billet 4 while repeating the advancing movement of the mandrel 51 and the retreating movement thereof in the state in which the mandrel 51 is inserted in the bearing hole 2*a* of the die 2. That is, the larger diameter hollow portion 52*a* is formed by advancing the punch 5 in the state in which the larger diameter columnar portion 51*a* of the mandrel 51 is positioned on the line A—A in FIG. 9 which coincides with the inner peripheral edge of the inlet side of the bearing hole 2*a* of the die 2.

On the other hand, the smaller diameter hollow portion 52*b* is formed by advancing the punch 5 in the state in which the smaller diameter columnar portion 51*b* of the mandrel 5 is positioned on the line A—A. By repeating the above operation, the extruded article W5 shown in FIG. 9 in which the cross-sectional shape changes can be obtained.

Sixth Embodiment

Figure 10:
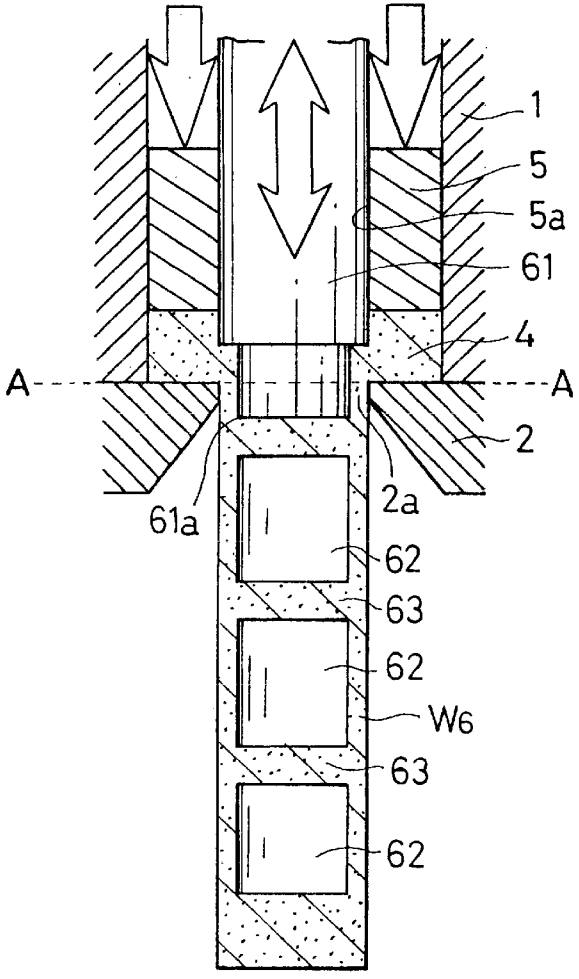
FIG. 10 is a schematic cross-sectional view showing an extrusion process of a manufacturing method using a columnar shaped mandrel according to a sixth embodiment of the present invention.

In place of the cone-shaped tip end portion of the mandrel shown in the first to fourth embodiments in which the diameter changes continuously, a columnar shaped tip end portion as shown in FIG. 10 may be employed. The mandrel having such a columnar shape can also manufacture an extruded article changing in cross-section along the direction of the extrusion axis direction by combining the advancing movement of the mandrel and the retreating movement thereof.

The mandrel 61 shown in FIG. 10 has a columnar portion 61*a* circular or square in cross-section at the tip of a basal portion.

In this mandrel 61, although the portion which participates in forming the hollow portion 62 is constant in outer diameter, an extruded article W6 including a hollow portion 62 and a non-hollow portion 63 alternatively arranged in the direction of the extrusion axis can be manufactured by combining the advancing movement of the mandrel 61 and the retreating movement thereof.

The extruded article W6 is manufactured by extruding the billet 4 while repeatedly changing the position of the mandrel 61 between the position where the mandrel 61 is inserted in the bearing hole 2*a* of the die 2 and the position where the mandrel 61 is retreated behind the inner peripheral edge of the bearing hole 2*a*. In detail, the hollow portion 62 is formed by advancing the punch 5 in the state in which the columnar portion or square pillar portion 61*a* of the mandrel 61 is located on the line A—A in FIG. 10 which coincides with the inner peripheral edge of the bearing hole 2*a* of the die 2. On the other hand, the non-hollow portion 63 is formed by advancing the punch 5 in the state in which the mandrel 61 is disposed behind the inner peripheral edge of the bearing hole 2*a*. By repeating the above operation, the extruded article W6 repeatedly changing in cross-section shown in FIG. 10 can be obtained.

Seventh Embodiment

The mandrel 71 shown in FIG. 11A has, at its tip end, two half cone-shaped members 71*a* and 71*a* arranged via a slot 74. Each half cone-shaped member 71*a* forms a hollow portion 72 corresponding to the cross-section of the half cone-shaped member 71*a* corresponding to the line A—A which coincides with the inner peripheral edge of the bearing hole 2*a* of the die 2. As a result, as shown in FIGS. 11B and 11C, in a cross-section of the extruded article, a plural number of hollow portions 72 corresponding to the divided number of the tip portion of the mandrel 71 can be formed.

In the extruded article W7, the portion 72*a* and 72*c* in which the diameter is decreasing is formed by advancing the punch 5 while retreating the mandrel 71. The portion 72*b* and 72*d* in which the diameter is increasing is formed by advancing the punch 5 while advancing the mandrel 71.

The non-hollow portion 73 is formed by advancing the punch 5 in the state in which the mandrel 71 is retreated behind the inner peripheral edge of the bearing hole 2*a* of the die 2.

The above-mentioned mandrel 71 may have a half pyramid shaped member in replace of the aforementioned half cone-shaped member.

In addition, in this embodiment, although a plurality of the same shaped hollow portions are formed by providing the slot 74 in the cone or pyramid-shaped mandrel, a plurality of different shaped hollow portions may be formed by changing the outer peripheral shape and/or the position of the slit. Moreover, a plurality of independent mandrels may be used to form a plurality of hollow portions corresponding to the respective mandrel. In this case, hollow portions different in shape can be formed by independently controlling the moving direction of each mandrel and the speed thereof.

Eighth Embodiment

As shown in FIGS. 12A and 12B, the extruded article W8 changing in cross-section along the longitudinal direction can be manufactured by rotating the mandrel 81 asymmetrical to the extrusion axis about the extrusion axis.

The mandrel 81 shown in FIG. 12A has, at its tip end side, a generally cone-shaped portion having a vertex in the position shifted from the extrusion axis and a columnar tip end portion 83 on the tip end thereof.

As shown in FIGS. 12A and 12B, the punch 5 is advanced while rotating the mandrel 81 in the state in which the columnar tip end portion 83 of the mandrel 81 is inserted into the bearing hole 2*a* of the die 2. This forms a spiral hollow portion 82 constant in diameter within the extruded article W8.

Ninth Embodiment

Figures 13A, 13B, 13C:
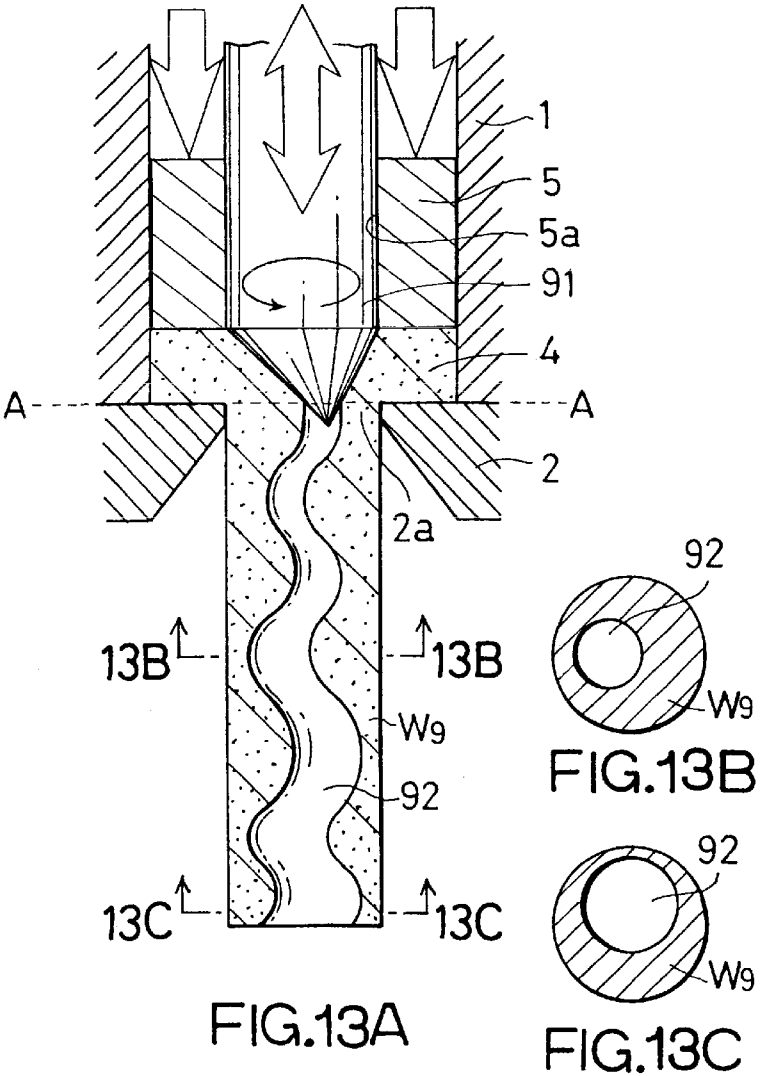
FIG. 13A is a schematic cross-sectional view showing an extrusion process of a manufacturing method using a mandrel which retreats while rotating according to a ninth embodiment of the present invention.
FIG. 13B is a cross-sectional view taken along the 13B—13B in FIG. 13A.
FIG. 13C is a cross-sectional view taken along the line 13C—13C in FIG. 13A.

The mandrel 91 shown in FIG. 13A has, at its tip end, a generally cone-shaped portion which has a vertex in the position shifted from the extrusion axis, and is capable of rotating about the extrusion axis and advancing/retracting along the extrusion axis.

As shown in FIG. 13A, the mandrel 91 is inserted into the bearing hole 2*a* of the die 2. In this sate, the punch 5 is advanced while rotating the mandrel 91.

As a result, as shown in FIGS. 13A to 13C, the extruded article W9 having a spiral shaped hollow portion 92 with an inner diameter corresponding to the outer diameter of the mandrel 91 corresponding to the line A—A which coincides with the inner peripheral edge of the bearing hole 2*a* of the die 2.

Although the rotary axis of each mandrel of the eighth and ninth embodiments coincides with the extrusion axis, a mandrel may be shifted and rotated about an axis parallel to the extrusion axis.

Tenth Embodiment

Figure 14B:
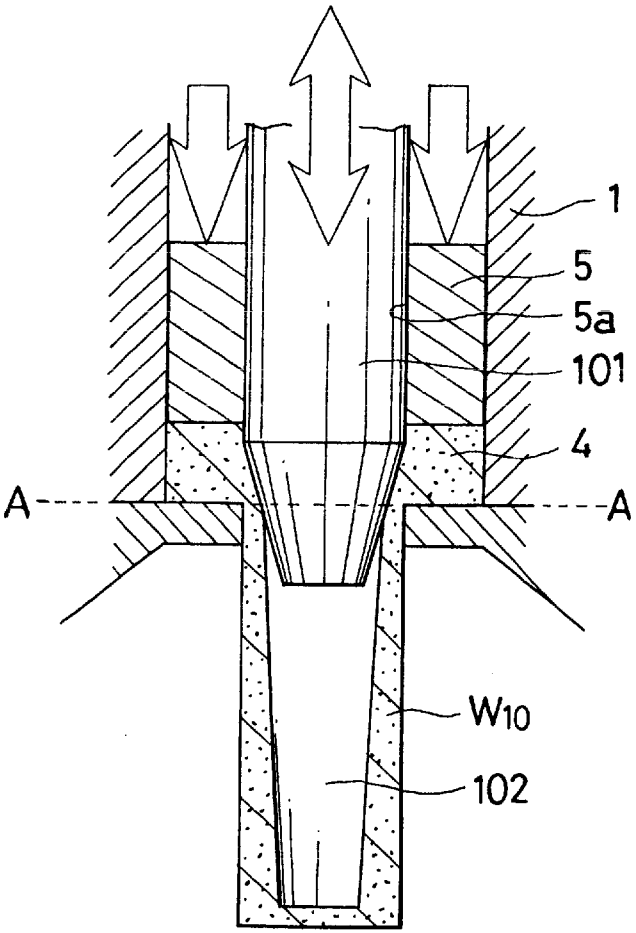
FIG. 14B shows the process of forming the hollow portion.
Figure 14A:
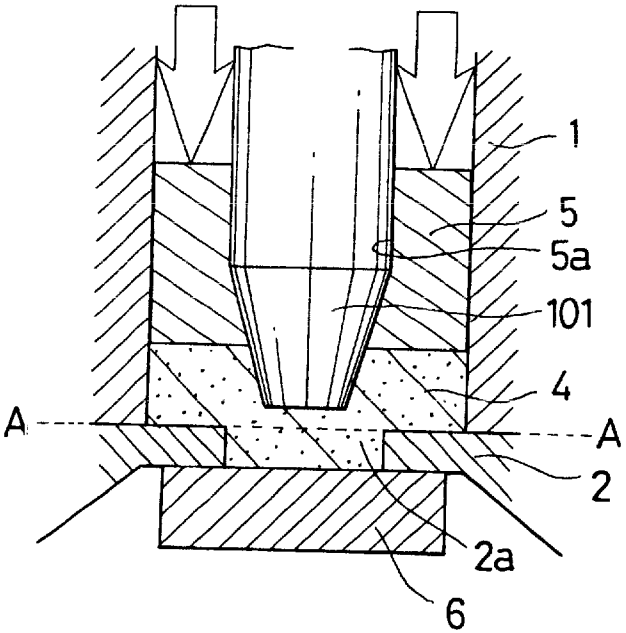

As shown in FIG. 14A, the outlet side of the bearing hole 2*a* of the die 2 is covered by a lid member 6 at the beginning of the extrusion. Then, the punch 5 is advanced to fill the bearing hole 2*a* of the die 2 with the billet 4. Thereafter, as shown in FIG. 14B, the lid member 6 is removed, and then the billet 4 is extruded by using the mandrel 101 and the punch 5 to form the extruded article W10 having a hollow portion 102. Thus, the extruded hollow article W10 having a closed end can be manufactured.

Eleventh Embodiment

Figure 15B:
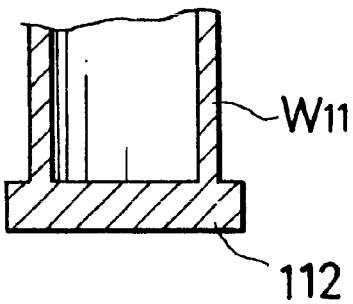
FIG. 15B is sectional view of the principal portion of the manufactured extruded article.
Figure 15A:
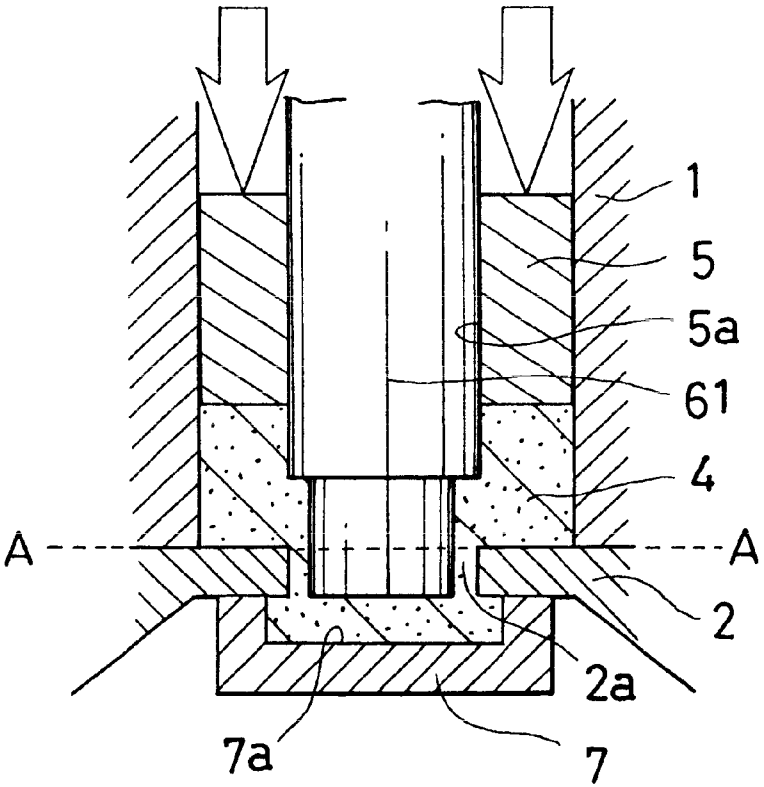
FIG. 15A is a schematic cross-sectional view showing an extrusion process of a manufacturing method by which an extruded article having a closed end is formed according to an eleventh embodiment of the present invention.

Moreover, various end shapes of extruded hollow articles can be formed by changing a shape of a lid member. An example of a lid member 7 is shown in FIG. 15A. The lid member 7 has a dented portion 7*a* having a diameter larger than that of the bearing hole 2*a* and is disposed so as to cover the bearing hole 2*a*. In this state, by advancing the punch 5, the extruded article W11 having a closed end with a lib portion 112 can be formed as shown in FIG. 15B.

Since these extruded articles W10 and W11 include a non-hollow end portion having a cross-sectional area larger than that of the remaining portion, a joining area can be increased, which enhances joining strength. In addition, the aforementioned extrusion process for forming a closed end portion of the extruded article applied to the tenth and eleventh embodiments can be also applied to any one of first to ninth embodiments irrespective of the shape and/or movement of a mandrel to form a closed end portion.

As mentioned above, according to the present invention, a method for manufacturing an extruded article which has at least one hollow portion and changes in cross-section along a direction of an extrusion axis, includes the step of advancing a punch to extrude a billet while controlling a movement of a mandrel for defining an inner periphery of the hollow portion relative to a die for defining an-outer periphery of the extruded article.

With this method, the positional relation between the die and the mandrel changes during the extrusion process, which forms an extruded article having a cross-sectional shape corresponding to the change of the positional relation. In such an extruded article, any desired longitudinal portion can have a required cross-sectional shape and/or a cross-sectional area depending on a usage, which can avoid using excessive materials. This results in a reduction of material cost and a lightened extruded article.

In cases where the mandrel is controlled so as to advance or retreat in the direction of the extrusion axis while the punch is advancing, an extruded article changing in cross-section along the direction of the extrusion axis can be obtained. Especially, in cases where the mandrel is controlled so as to move in both the advancing direction and the retreating direction, the cross-sectional shape of the extruded article can be changed along the direction of the extrusion axis by repeating the advancing and retreating movements.

In cases where the mandrel is controlled so as to retreat until a tip end of the mandrel is located behind the bearing hole of the die, an extruded article having a non-hollow portion can be obtained by advancing the punch in the state in which the mandrel is retreated behind the bearing hole. Therefore, an extruded article having both a hollow portion and a non-hollow portion can be manufactured along the direction of the extrusion axis.

In cases where the mandrel has a tip end portion asymmetrical to a rotary axis of the mandrel and the mandrel is controlled so as to rotate about the extrusion axis or an axis paralleled to the extrusion axis while the punch is advancing, an extruded article having a spiral hollow portion can be manufactured by rotating the mandrel.

In cases where a moving speed of the mandrel is controlled independently of a moving speed of the punch, the relative relation between the extruding speed of the billet and the moving speed of the mandrel can be changed, which results in a changing cross-sectional shape such as a changing taper angle of the hollow portion corresponding to the change of the relative relation.

The mandrel may be controlled so as to move continuously or intermittently. By continuously moving the mandrel, a continuous cross-sectional change of the hollow portion can be attained.

In cases where the mandrel is controlled to move intermittently, a hollow portion having a constant cross-section can be obtained by extruding the billet in the state in which the mandrel is stopped, and a hollow portion having a changing cross-section can be obtained by extruding the billet in the state in which the mandrel is moving. As a result, an extruded article having a portion in which a cross-sectional shape is constant along the length thereof and a portion in which a cross-sectional shape changes along the length thereof can be formed.

In any one of the aforementioned method, by applying a pressure to the billet in the state in which a bearing hole of the die is closed to fill the bearing hole with the billet and releasing a closing of the bearing hole prior to the step of extruding the billet by the mandrel and the punch, an extruded article having a non-hollow end portion and a hollow portion can be manufactured. In such an extruded article, the end cross-sectional area becomes larger, resulting in an increased joining area, which in turn enables a strong joint to another member.

This application claims priority to Japanese Patent Application No. H11-374436 filed on Dec. 28, 1999, the disclosure of which is incorporated by reference in its entirety.

The terms and expressions which have been employed herein are used as terms of description and not of limitation, and there is no intent, in the use of such terms and expressions, of excluding any of the equivalents of the features shown and described or portions thereof, but it is recognized that various modifications are possible within the scope of the invention claimed.

What is claimed is:

1. A method for manufacturing an extruded article which has at least one spiral hollow portion and changes in cross-section along a direction of an extrusion axis, the method including the step of:

advancing a punch to extrude a billet while controlling a movement of a mandrel for defining an inner periphery of said hollow portion relative to a die for defining an outer periphery of said extruded article, wherein said mandrel has a tip end portion asymmetrical to a rotary axis of said mandrel, and wherein said mandrel is controlled so as to rotate about said extrusion axis or an axis parallel to said extrusion axis while advancing said punch.

2. The method for manufacturing an extruded article as recited in claim 1, wherein said mandrel is controlled so as to advance or retreat in said direction of said extrusion axis.

3. The method for manufacturing an extruded article as recited in claim 2, wherein said mandrel is controlled so as to retreat until a tip end of said mandrel is located behind a bearing hole of said die.

4. The method for manufacturing an extruded article as recited in claim 1, wherein a moving speed of said mandrel is controlled independently of a moving speed of said punch.

5. The method for manufacturing an extruded article as recited in claim 1, wherein said mandrel is controlled so as to move continuously.

6. The method for manufacturing an extruded article as recited in claim 1, wherein said mandrel is controlled so as to move intermittently.

7. An apparatus for manufacturing an extruded article which has at least one spiral hollow portion and changes in cross-section along a direction of an extrusion axis, said apparatus comprising:

a container in which a billet is loaded;

a punch for applying a forward pressure to said billet;

a die for defining an outer periphery of said extruded article; and a mandrel for defining an inner periphery of said hollow portion, wherein said mandrel has a tip end portion asymmetrical to a rotary axis of said mandrel, and wherein said mandrel is capable of rotating about said extrusion axis and moving relative to said die when said punch is advancing, whereby said extruded article is formed by advancing said punch to extrude said billet while controlling a movement of said mandrel relative to said die.

8. The apparatus for manufacturing said extruded article as recited in claim 7, wherein said mandrel is capable of advancing and/or retreating relative to said die.

9. The apparatus for manufacturing said extruded article as recited in claim 7, wherein said mandrel has a tip end portion asymmetrical to a rotary axis of said mandrel, and wherein said mandrel is capable of rotating about said extrusion axis when said punch is advancing.

10. A method for manufacturing an extruded article which has at least one hollow portion and a closed end portion and changes in cross-section along a direction of an extrusion axis, the method including the steps of:

applying a pressure to a billet by a punch in a state in which a bearing hole of a die for defining an outer periphery of said extruded article is closed so as to fill said bearing hole with materials of said billet to thereby form said closed end portion;

releasing a closing of said bearing hole; and then moving a mandrel for forming said hollow portion and;

advancing said punch to extrude said billet to thereby form said extruded article.

11. The method for manufacturing an extruded article as recited in claim 10, wherein said mandrel is controlled so as to advance or retreat in said direction of said extrusion axis.

12. The method for manufacturing an extruded article as recited in claim 11, wherein said mandrel is controlled so as to retreat until a tip end of said mandrel is located behind a bearing hole of said die.

13. The method for manufacturing an extruded article as recited in claim 10, wherein said mandrel has a tip end portion asymmetrical to a rotary axis of said mandrel, and wherein said mandrel is controlled so as to rotate about said extruded axis or an axis parallel to said extrusion axis while advancing said punch.

14. The method for manufacturing an extruded article as recited in claim 10, wherein a moving speed of said mandrel is controlled independently of a moving speed of said punch.

15. The method for manufacturing an extruded article as recited in claim 10, wherein said mandrel is controlled so as to move continuously.

16. The method for manufacturing an extruded article as recited in claim 10, wherein said mandrel is controlled so as to move intermittently.

17. An apparatus for manufacturing an extruded article which has at least one hollow portion and a closed end portion and changes in cross-section along a direction of an extrusion axis, said apparatus comprising:

a container in which a billet is loaded;

a punch for applying a forward pressure to said billet;

a die having a bearing hole for defining an outer periphery of said extruded article;

a mandrel for defining an inner periphery of said hollow portion, said mandrel being capable of moving relative to said die; and a closing member detachably disposed at an outlet side of said bearing hole so as to close said bearing hole, whereby a pressure is applied to said billet in a state in which a bearing hole of said die is closed by said closing member to fill said bearing hole with materials of said billet to thereby form said closed end portion, then a closing of said bearing hole is released by detaching said closing member from said die, and thereafter said punch is advanced to extrude said billet while controlling a movement of said mandrel relative to said die to thereby form said extruded article having said hollow portion.

18. The apparatus for manufacturing said extruded article as recited in claim 17, wherein said mandrel is capable of advancing and/or retreating relative to said die.

19. The apparatus for manufacturing said extruded article as recited in claim 17, wherein said mandrel has a tip end portion asymmetrical to a rotary axis of said mandrel and is capable of rotating about said extrusion axis when said punch is advancing.

* * * * *